US006655793B2

(12) United States Patent
Jones et al.

(10) Patent No.: US 6,655,793 B2
(45) Date of Patent: Dec. 2, 2003

(54) PRINT CARTRIDGE SUPPORTING APPARATUS

(75) Inventors: Gene D Jones, Yacolt, WA (US); Steve O'Hara, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 107 days.

(21) Appl. No.: 10/109,169

(22) Filed: Mar. 26, 2002

(65) Prior Publication Data

US 2003/0184617 A1 Oct. 2, 2003

(51) Int. Cl.[7] ..... B41J 2/175
(52) U.S. Cl. ..... 347/86; 347/85
(58) Field of Search ..... 347/85, 86, 84

(56) References Cited

U.S. PATENT DOCUMENTS 5,581,287 A * 12/1996 Baezner ..... 347/85
5,933,173 A * 8/1999 Solero ..... 347/85
6,027,209 A * 2/2000 Menendez ..... 347/85

FOREIGN PATENT DOCUMENTS

EP 0729844 9/1996

* cited by examiner

*Primary Examiner*—Thinh Nguyen

(57) ABSTRACT

Apparatus that includes a chute for receiving the print cartridge, a latch arm hingeably attached to the chute for rotation about a latch arm rotation axis, a clamp structure supported by the latch arm and supporting a clamp blade to be deflectable about a clamp rotation axis and deflectable along a clamp translation axis.

38 Claims, 9 Drawing Sheets

FIG. 6
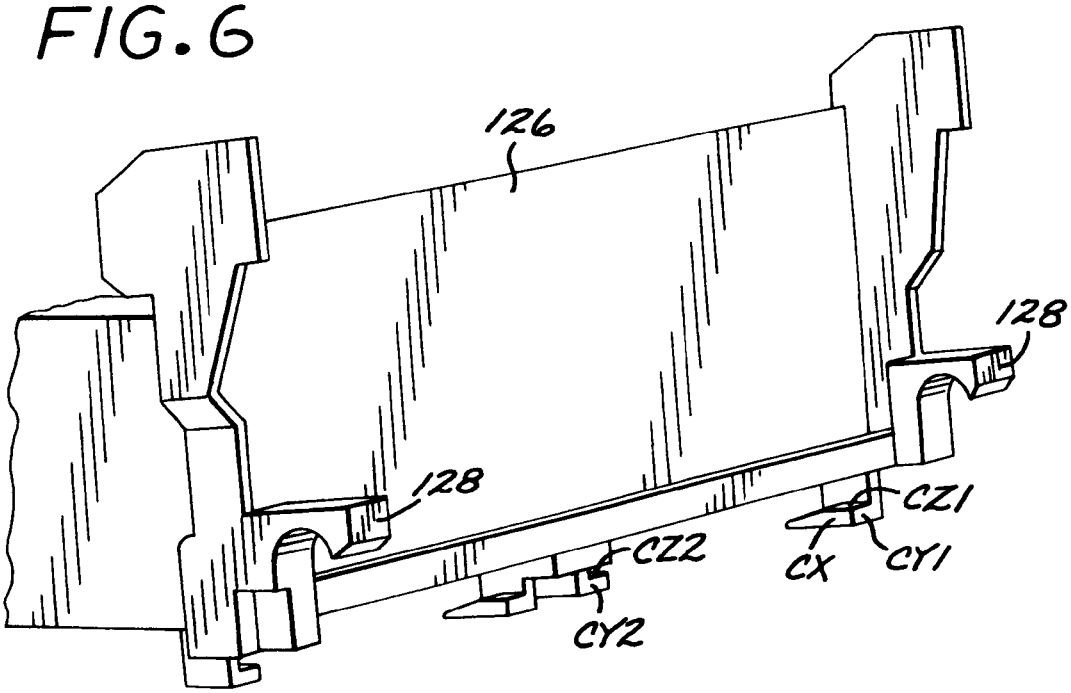
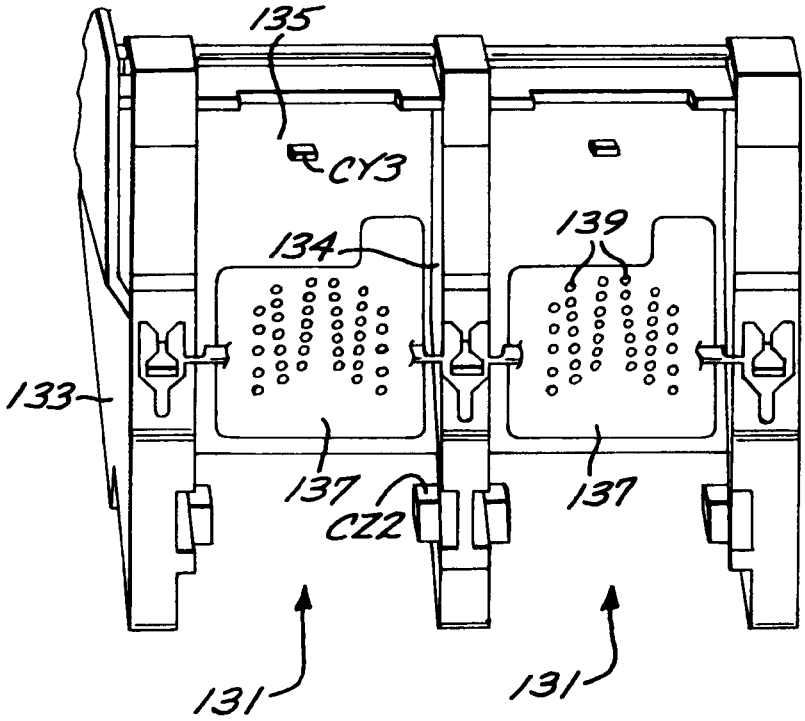
FIG. 7

FIG. 10
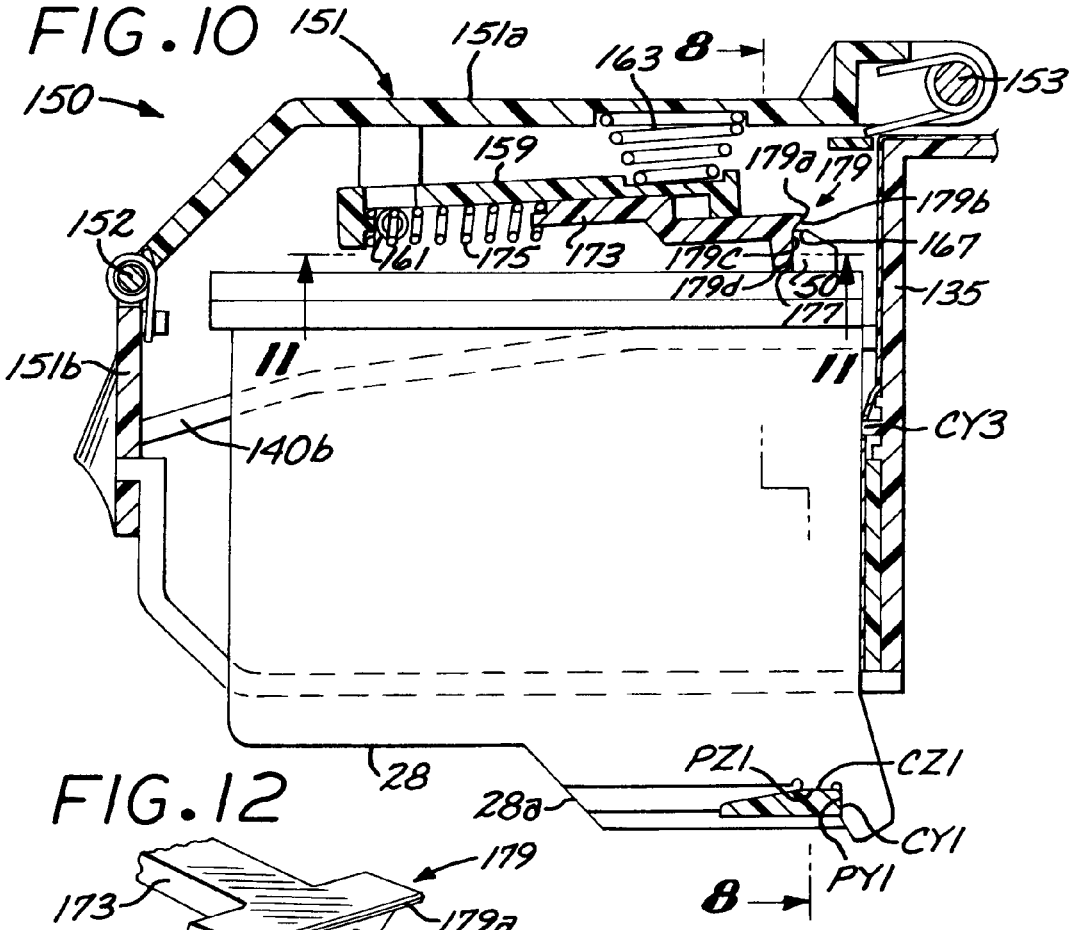
FIG. 12
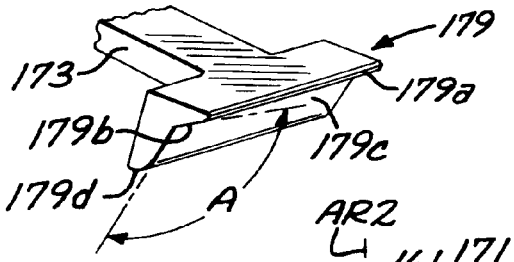
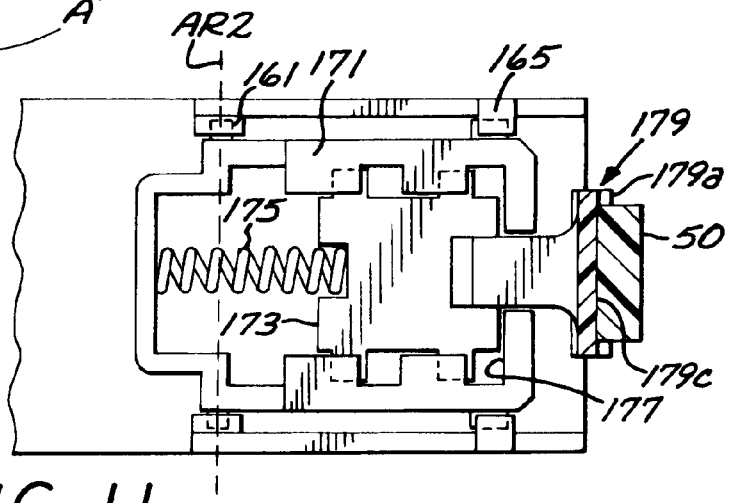
FIG. 11

FIG. 13
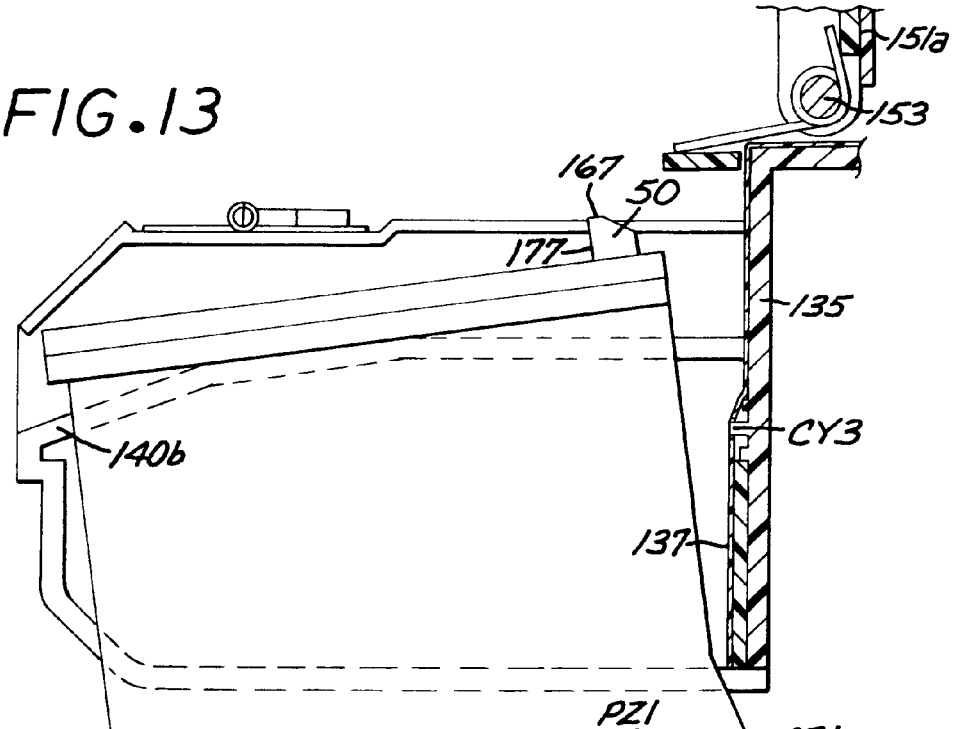
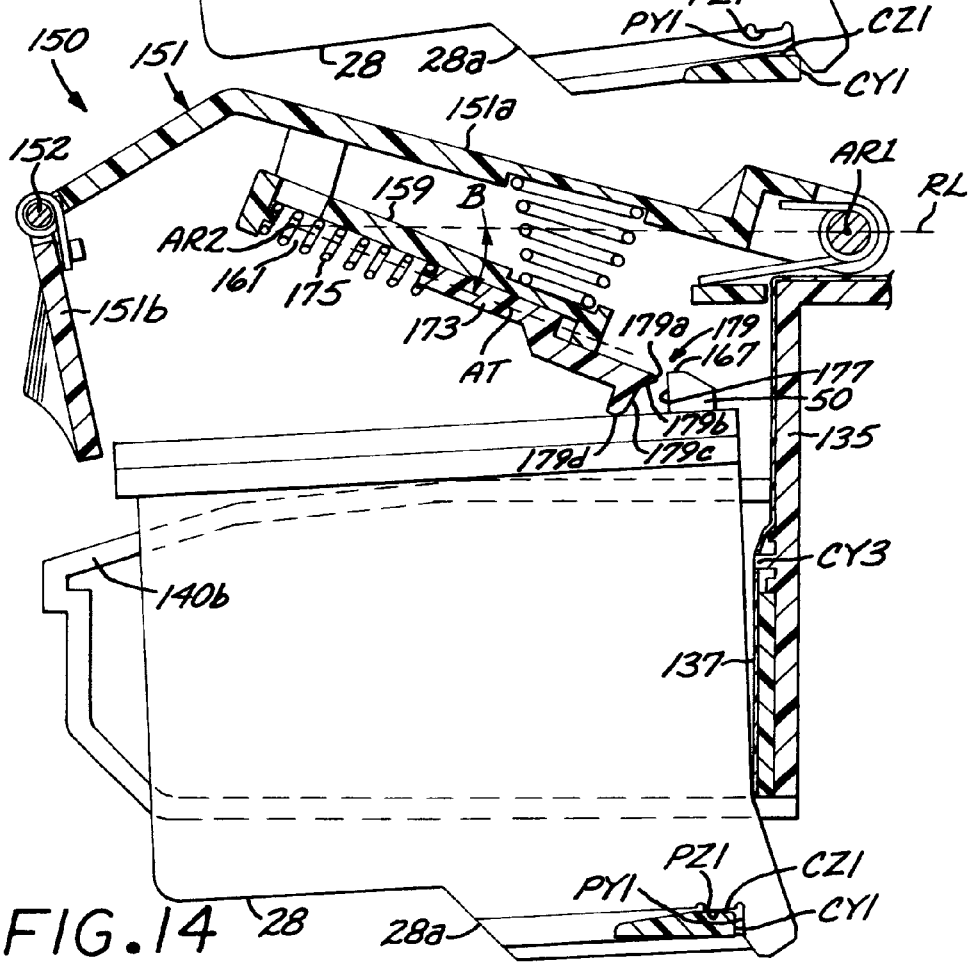
FIG. 14

PRINT CARTRIDGE SUPPORTING APPARATUS

BACKGROUND OF THE DISCLOSURE

An ink jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink jet printers print dots by ejecting very small drops of ink onto the print medium, and typically include a movable print carriage that supports one or more print cartridges each having ink ejecting nozzles. The print carriage traverses back and forth over the surface of the print medium, and the nozzles are controlled to eject drops of ink at appropriate times pursuant to command of a microcomputer or other controller, wherein the timing of the application of the ink drops is intended to correspond to the pattern of pixels of the image being printed. Typically, a plurality of rows of pixels are printed in each traverse or scan of the print carriage. The particular ink ejection mechanism within the printhead may take on a variety of different forms known to those skilled in the art, such as those using thermal printhead or piezoelectric technology. For instance, two earlier thermal ink jet ejection mechanisms are shown in commonly assigned U.S. Pat. Nos. 5,278,584 and 4,683,481. In a thermal system, an ink barrier layer containing ink channels and ink vaporization chambers is disposed between a nozzle orifice plate and a thin film substrate. The thin film substrate typically includes arrays of heater elements such as thin film resistors which are selectively energized to heat ink within the vaporization chambers. Upon heating, an ink droplet is ejected from a nozzle associated with the energized heater element. By selectively energizing heater elements as the printhead moves across the print medium, ink drops are ejected onto the print medium in a pattern to form the desired image.

Certain ink jet printers employ disposable print cartridges that are replaced when empty, and it is often difficult to accurately and consistently position a print cartridge in the printer relative to another print cartridge and relative to the entire printer.

BRIEF DESCRIPTION OF THE DRAWINGS

Features and advantages of the disclosure will readily be appreciated by persons skilled in the art from the following detailed description when read in conjunction with the drawing wherein:

FIG. 6 is a schematic front partial perspective view of the print carriage of FIG. 4, with the cartridges and the latch assemblies removed.

FIG. 7 is a schematic rear partial perspective view of the print carriage of FIG. 4, with the cartridges and the latch assemblies removed.

FIG. 10 is a schematic sectional elevational view of a chute and latch assembly of the print carriage of FIG. 4 showing the latch assembly in a latched or closed position.

FIG. 11 is a schematic plan view of a clamp structure of the latch assembly of the print carriage of FIG. 4.

FIG. 12 is a schematic perspective view of a clamp blade of the clamp structure of FIG. 11.

FIGS. 13–17 schematically depict the latch assembly at various states as it is moved to a latched or closed position.

DETAILED DESCRIPTION OF THE DISCLOSURE

Figure 1:
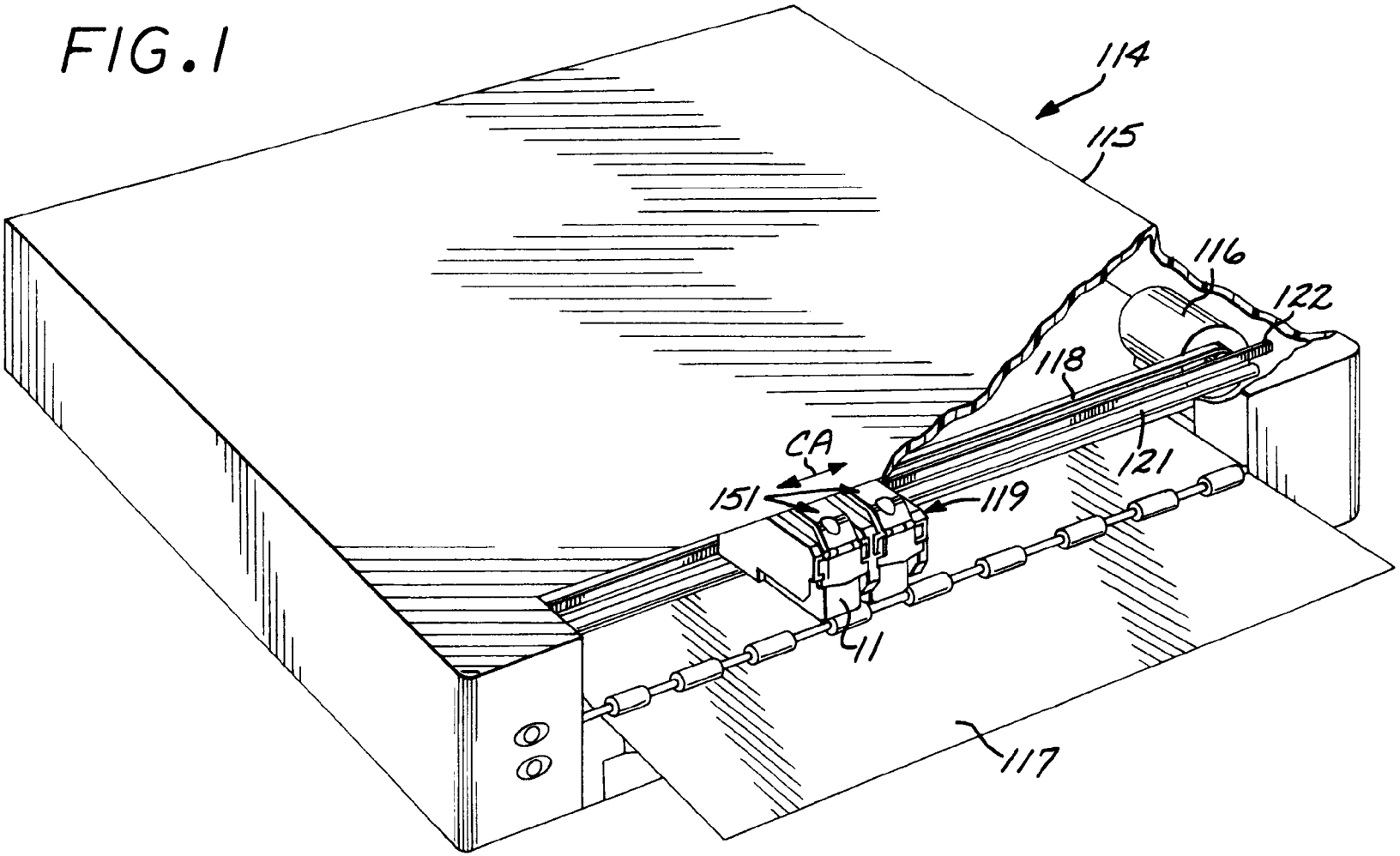
FIG. 1 is a schematic partial cut away perspective view of a printer embodying principles disclosed in the specification.

Referring now to FIG. 1, schematically depicted therein is an ink jet printer 114 partially cut away and with its front loading door removed. The printer includes a case or housing 115 and carriage drive motor 116 mounted on a chassis. The motor drives a belt 118 back and forth as the drive motor reverses direction. The drive belt 118 is attached to a print carriage 119 that scans laterally back and forth along a carriage scan axis CA from left to right and right to left over a print medium 117. The print carriage 119 contains two externally similar thermal ink jet print cartridges 11 located side by side. For example, one of the print cartridges can contains black ink while the other has three ink chambers containing magenta, yellow and cyan inks. The horizontal scanning motion of the print carriage 119 is guided by a slider rod 121. Located in the rear of the carriage 119 is an encoder, not shown, that reads a position encoder strip 122 provides information of the location of the print carriage 119 along the carriage axis CA.

Figure 4:
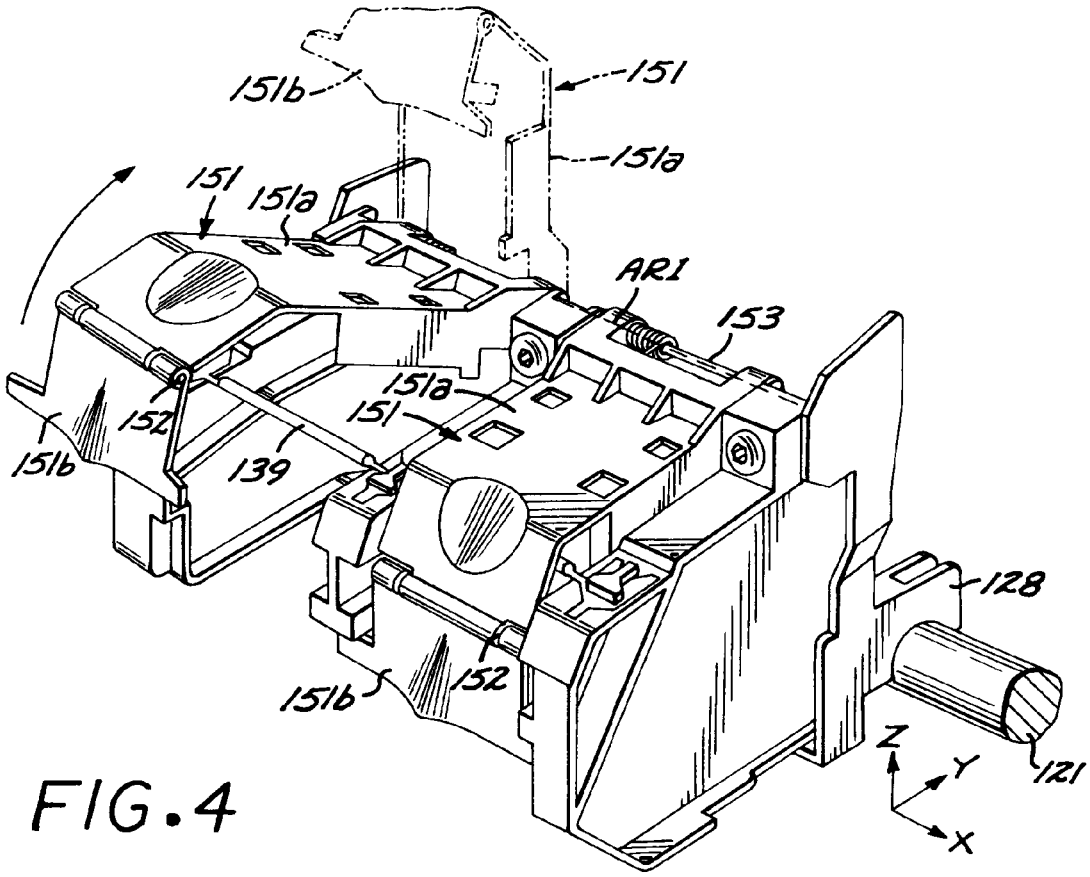
FIG. 4 is a schematic perspective view of the print carriage of the printer of FIG. 1.
Figure 5:
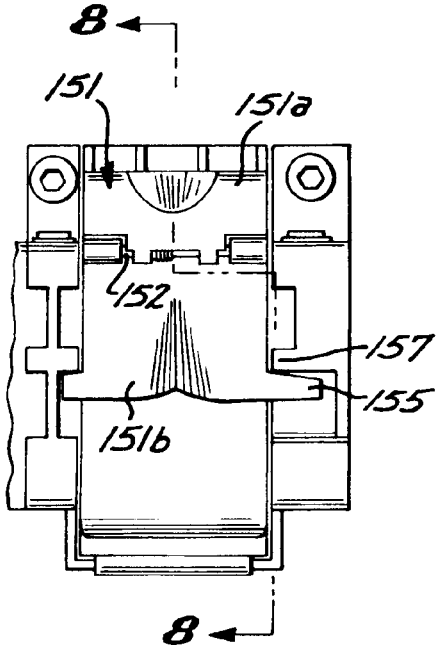
FIG. 5 is a schematic front elevational view of a chute and latch assembly of the print carriage of FIG. 4.
Figure 8:
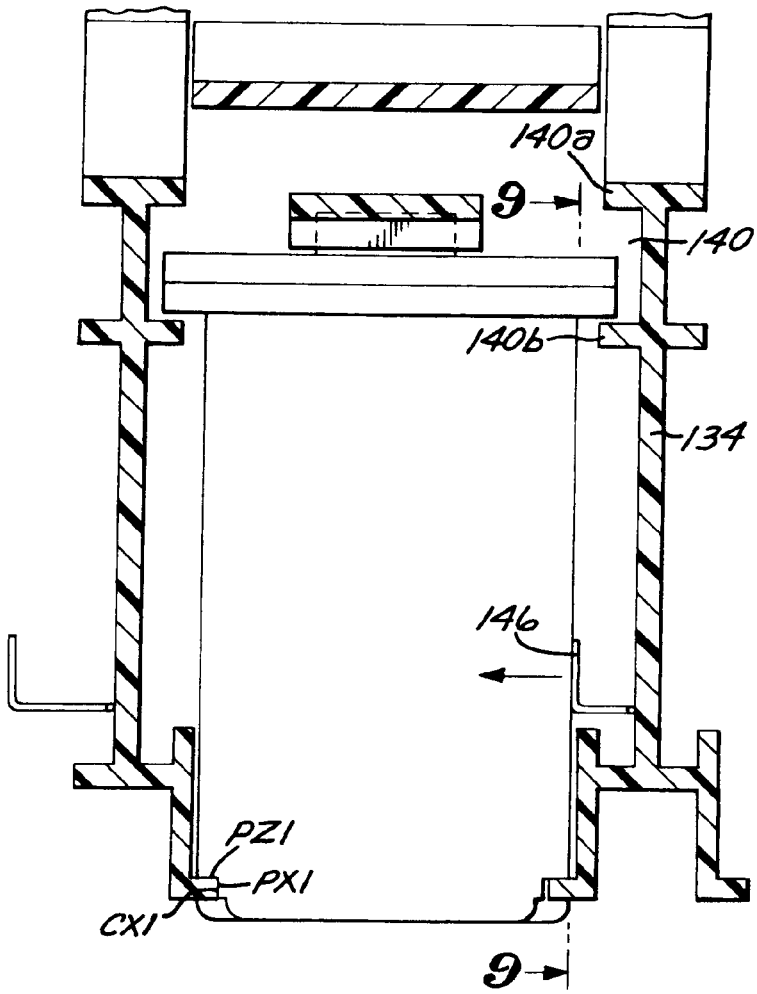
FIG. 8 is a schematic sectional elevational view of a chute of the print carriage of FIG. 4.
Figure 9:
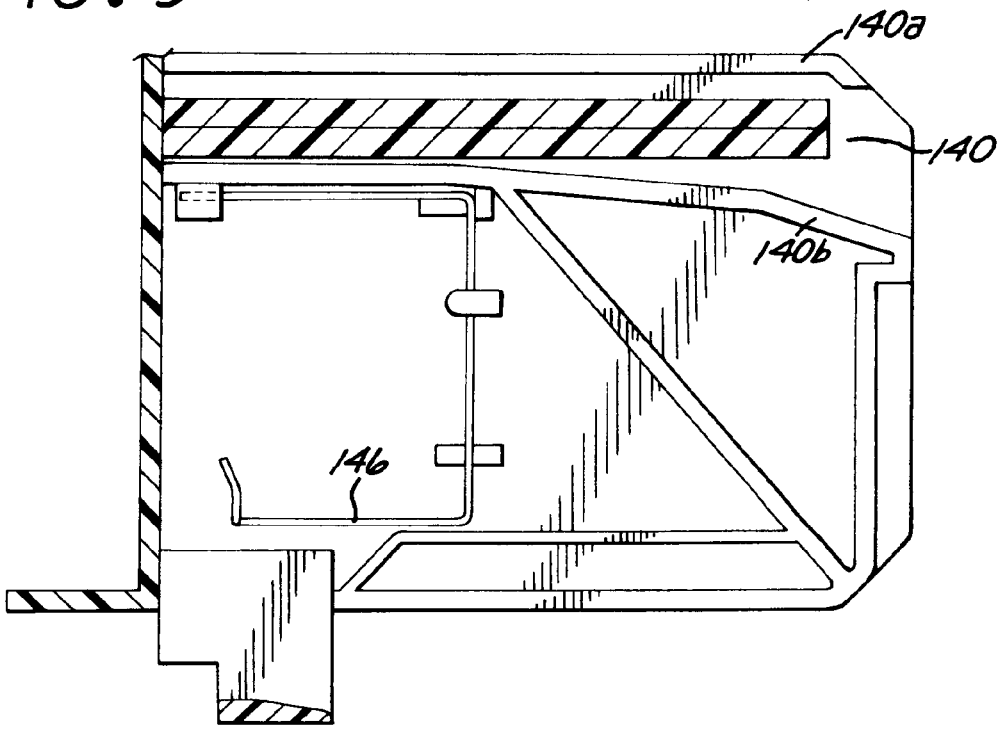
FIG. 9 is a schematic sectional elevational view of a side wall of a chute of the print carriage of FIG. 4.

The print carriage 119 includes a cartridge latching system that positions the print cartridges 11 relative to an orthogonal coordinate system shown in FIG. 4. The X axis is parallel to the carriage scan axis. The Y axis is parallel to and opposite a media advance path which for example extends horizontally out of the printer 114, such that the X and Y axes define a horizontal XY plane. The Z axis extends vertically to the XY plane.

Figure 2:
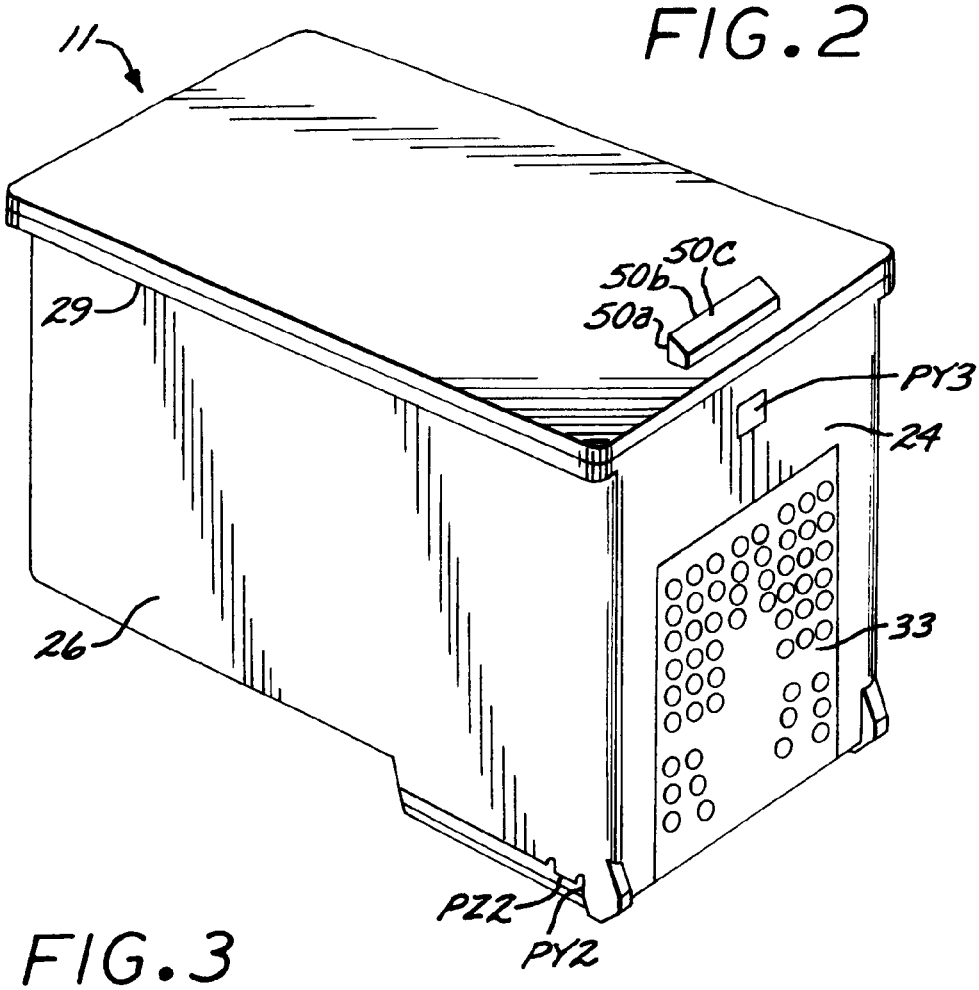
FIG. 2 is a schematic perspective view of an ink jet print cartridge of the printer of FIG. 1.
Figure 3:
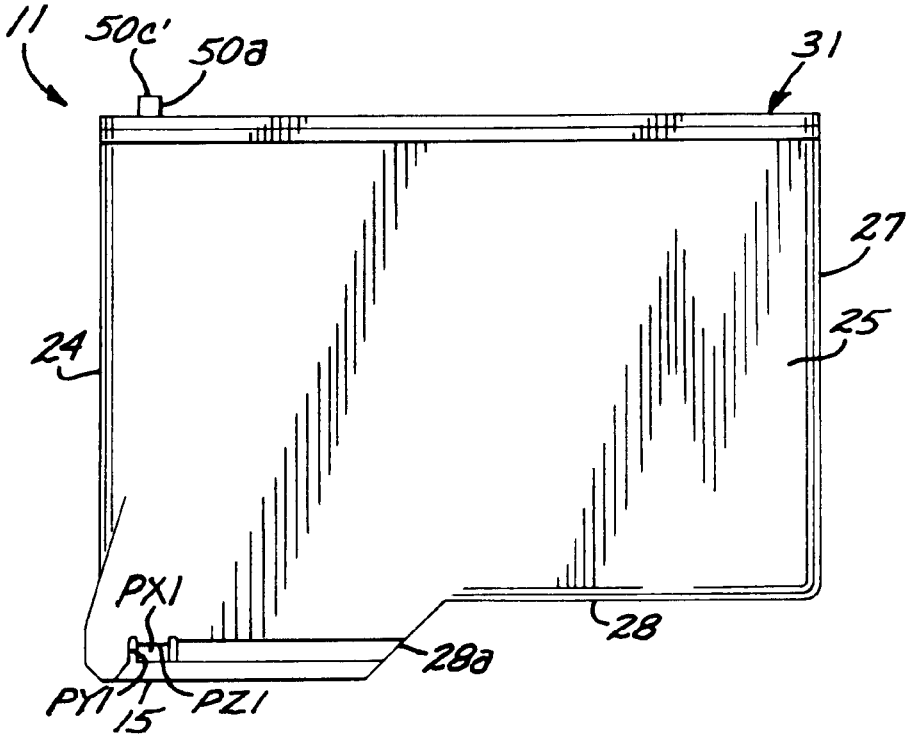
FIG. 3 is a schematic side elevational view of the ink jet print cartridge of FIG. 2.

Referring now to FIGS. 2 and 3, the print cartridge 11 more particularly includes a print cartridge body comprised of a rear wall 24, a left side wall 25, a right side wall 26, a front wall 27, and a bottom wall 28 that includes a snout section 28*a* that supports an ink jet printhead 15. A top wall or lid 31 is attached to the upper edges of the front, side, and rear walls, and includes margins or lips 29 that extend beyond the front and side walls. A latch catch or feature 50 is disposed on the lid 31 close to the top boundary of the rear wall 24. The latch feature 50 extends upwardly from the top wall 31 and includes a front latch surface 50*a* and a rearwardly extending surface 50*c* that intersects the top of the front latch surface 50 at a front lateral edge 50*b*. By way of illustrative example, the front latch surface 50*a* is perpendicular to the lid 31 while the rearwardly extending surface 50*c* can be a ramped surface that extends downwardly and rearwardly from the top of the front latch surface 50*a*. Alternatively, the rearwardly extending surface of the latch feature can comprise a horizontal surface 50*c*as illustrated in FIG. 3. As described further herein, a clamp pushes down on a top portion of the front lateral edge 50*b*.

Located in the vicinity of the intersection of the left side wall 25, rear wall 24 and snout 28*a* are a printhead cartridge X axis datum PX1, a first printhead cartridge Y axis datum PY1, and a first printhead cartridge Z axis datum PZ1. Located in the vicinity of the intersection of the right side wall 26, rear wall 24 and snout 28*a* are a second printhead cartridge Y axis datum PY2 and a second printhead cartridge Z axis datum PZ2. A third printhead cartridge Y axis datum PY3 is located in the upper portion of the rear wall 24. The print cartridge Y axis datums generally comprise lands that are configured to be generally orthogonal to the Y axis when the cartridge is installed in the print carriage 119. The print cartridge Z axis datums comprise lands that are configured to be generally orthogonal to the Z axis when the print cartridge is installed in the print carriage 119. The print cartridge X axis datum comprises a land that is configured to be generally orthogonal to the, X axis when the print cartridge is installed in the print carriage 119.

Located on the rear wall 24 of the print cartridge is a flexible circuit 33 that provides electrical interconnection between the printer and the printhead 15, and routes electrical signals to the appropriate heater resistors of the printhead during printing.

Referring now to FIGS. 4–9, the print carriage 119 more particularly includes a support base 126 and two C-shaped bearings 128 located at the ends of the base 126. These C-shaped bearings 128 slidably support the print carriage 119 on the slider rod 121. The print carriage 119 further includes two chutes 131 that each receive, hold, and align an ink jet print cartridge 11. Both chutes are constructed and operate similarly. Each chute includes a rear wall 135 that comprises for example a portion of the base 126, a left side wall 133 that extends from the rear wall 135, and a right side wall 134 that extends from the rear wall 135 and is generally parallel to the left side wall 133.

Carriage datums CY1, CZ1 and CX1 formed for example as part of the base 126 are located at the bottom of the chute 131 in the vicinity of the intersection of the left side wall 133 the rear wall 135, while carriage datums CY2 and CZ2 for example as part of the base 126 are located at the bottom of the chute 131 in the vicinity of the vicinity of the intersection of the right side wall 134 and the rear wall 135. A carriage datum CY3 is located on the rear wall 135.

A resilient contact circuit 137 is located on the rear wall 135 of the chute and contains electrical contacts that are urged against corresponding contacts on the flex circuit 33 of the print cartridge 11. The resilient contact circuit 137 further functions as a resilient element that urges the print cartridge datums PY1, PY2 against carriage datums CY1, CY2 when the print cartridge 11 is installed. By way of illustrative example, the resilient contact circuit 137 comprises a flexible circuit and resilient pad located between the flexible circuit and the rear wall 135.

A cantilever spring 146 is located adjacent the right side wall 134, and functions to urge the print cartridge away from the right side wall 134 along the X-axis, so that the print cartridge datum PX1 is snugly engaged against the carriage datum CX1.

Located in each side wall 133, 134 is a shaped guide channel 140. The guide channels 140 engage lips 29 of the print cartridge 11, and guide the cartridge at an appropriate elevation and pitch (or rotation) of the cartridge about the X axis as the cartridge is inserted, so as to guide the cartridge into the general vicinity of the carriage datums. By way of illustrative example, each guide channel comprises upper and lower rails 140*a*, 140*b* or a recessed slot having appropriate sides.

A cross bar 139 spans the upper part of the front portion of chute 131 and is located above the guide channels 140. The cross bar prevents insertion of the cartridge from above, and further prevents spreading of the side walls in the event the cartridge is forced too low in the chute.

Located at the top of each chute 131 is a hinged latch assembly 150 that includes a latch support arm 151 that is rotatably attached by a hinge 153 to the top of the rear wall 135 so as to be hingably rotatable about a latch arm rotation axis AR1 that can be approximately or generally parallel to the X-axis. The latch support arm 151 includes a top portion 151*a* that extends from the hinge 153 and a front portion 151*b* that is hingeably attached at the distal end of the top portion 151*a*. Latch hooks 155 are located at the ends of the front portion 151*b* for engaging latch tabs 157 disposed at the front of the side walls 133, 134. The front portion 151*b* can be biased by a spring 152 to rotate toward the lower side of the top portion 151*a*.

Referring now to FIGS. 10–12, the hinged latch assembly further includes a pivoting biased clamp lever or base 159 hingeably attached to the lower side of the latch arm 151 by hinge posts 161 so as to be rotatable about a clamp rotation axis AR2 that is displaced from the latch arm rotation axis AR1 and can be approximately or generally parallel to the X-axis. The clamp lever 159 extends generally toward the chute rear wall 135 when the latch is closed, as particularly shown in FIG. 10. The clamp lever 159 is biased by a spring 163 to rotate away from the latch arm 151 and is resiliently or resistingly deflectable toward the latch arm 151. Stops 165 on either side of the clamp lever 159 limit the rotation of the clamp lever 159 away from the latch arm 151. The hinge posts 161 can be engaged in slots that allow slight movement toward and away from the latch arm, which allows the clamp lever 159 to pivot slightly about the stops 165.

The pivoting clamp lever 159 further includes tracks 171 in which a sliding clamp arm 173 is slidably located for movement generally along a clamp translation axis AT that is approximately or generally orthogonal to the clamp rotation axis AR2. An acute angle is formed by the clamp translation axis AT and an imaginary line IL that passes through the latch arm rotation axis AR1 and the clamp rotation axis AR2. The sliding clamp arm 173 is biased by a spring 175 to move along the pivoting clamp lever 159 away from the clamp hinge 161, and is resiliently or resistingly deflectable toward the clamp rotation axis AR2. Stops 177 limit the displacement of the sliding clamp arm 173. A clamp blade 179 is affixed to the distal end of the sliding clamp arm 173.

As more particularly depicted in FIG. 12, the clamp blade 179 can generally resemble a bulldozer blade and includes an upper or leading lateral edge 179*a*, an upper ramp surface 179*b* adjacent the leading lateral edge 179*a*, a lower surface 179*c* adjacent the upper ramp surface 179*b*, and a lower or trailing lateral edge 179*d* adjacent the lower surface 179*c*. The trailing edge 179*d* can be curved or radiused, for example. The upper ramp surface 179*b* and the lower surface 179*c* form an interior angle A that can be an obtuse angle, for example about 135 degrees. Generally, the angle A can be larger than the exterior angle between the front surface 50*a* and the top surface 50*c*, 50*c*' of the latch feature 50 of the print cartridge 11. The clamp blade can have a width dimension that is generally aligned with the X-axis, and such width can be configured to compensate for the rocking imparted by the offset between the location of the force applied by cantilever spring 146 and the location of the carriage X-axis datum CX1.

In use, the cartridge 11 is inserted generally horizontally into the chute 131. The guide channels 140 control the elevation and the pitch about the X axis of the cartridge 11 as it is inserted into the chute 131, such that print cartridge datums PY1, PY2 move over the corresponding carriage datums CY1, CY2. The print cartridge 11 can typically be left by the user in a position wherein the print cartridge is pitched up, as depicted in FIG. 13. The latch arm 151 is then rotated downwardly toward a latched position, and FIGS. 14–17 schematically depict various states of the latch assembly as it is moved to the latched position.

As depicted in FIG. 14, the clamp blade 179 contacts the top wall 31 of the print cartridge 11, for example with the trailing edge 179*d*, and slides toward the latch feature 50. As the clamp blade 179 contacts the top wall 31 of the print cartridge and slides along such top wall, it pushes down on the top wall. In this manner, the initial force on the print cartridge 11 is primarily down along the Z-axis, which tends to seat the print cartridge datums PZ1, PZ2 against the carriage Z-datums CZ1, CZ2.

Figure 15:
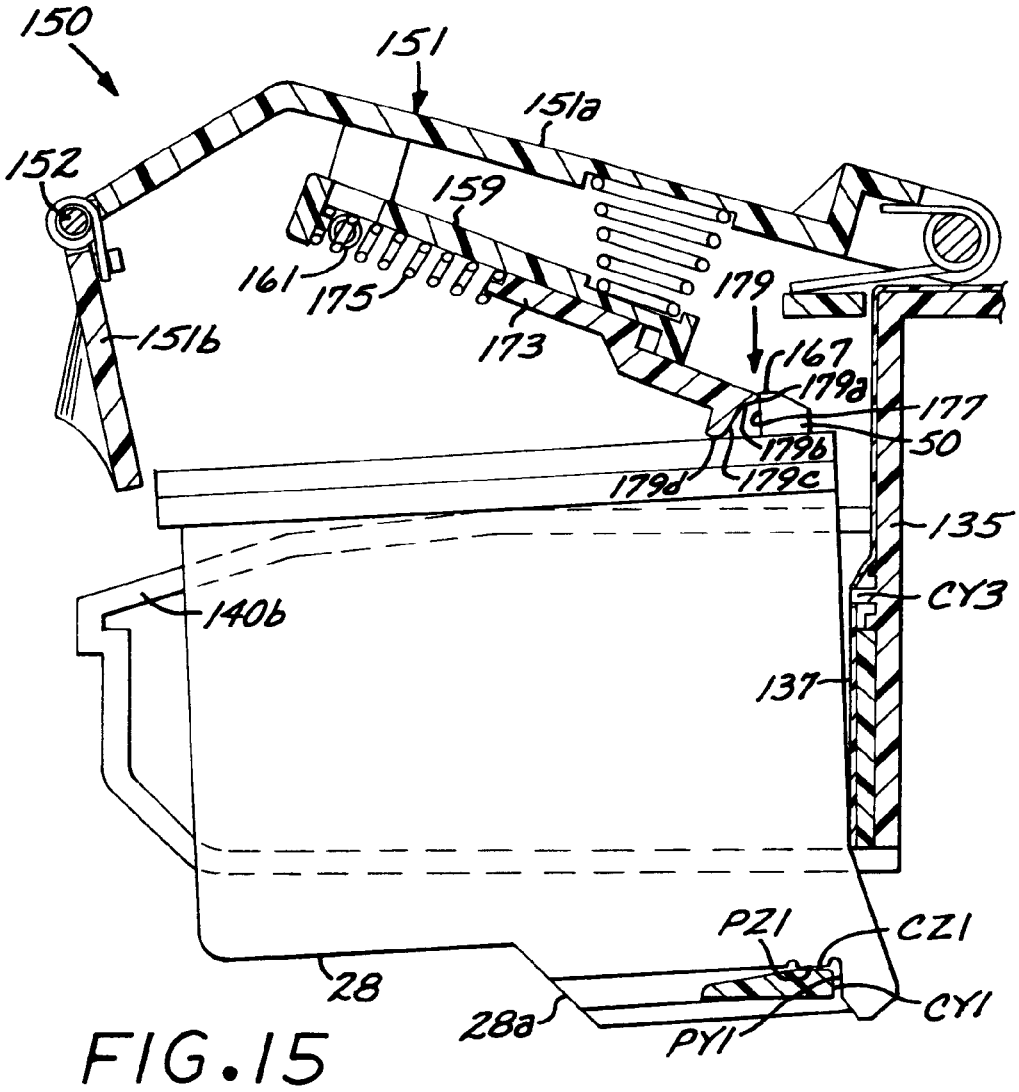
Figure 16:
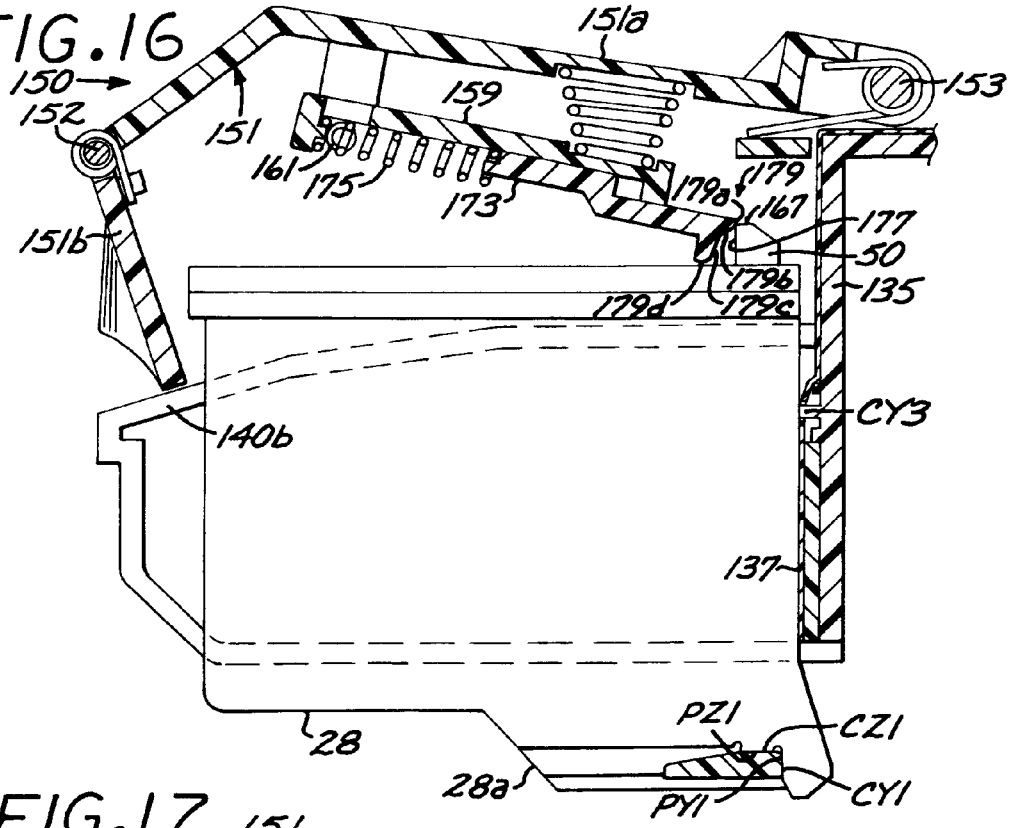

As depicted in FIG. 15, the leading edge 179*a* of the clamp blade 179 eventually contacts the front surface 50*a* of the latch feature 50 and pushes on such surface generally along the Y-axis. The push generally along the Y-axis causes the print cartridge to pivot about the X axis so that the print cartridge datum PY3 snugly seats against the carriage datum CY3, as shown in FIG. 16. The resilient contact circuit 137 is located so as to cause the print cartridge datums PY1, PY2 to seat snugly against the carriage datum CY1, CY2 when the print cartridge datums PZ1, PZ2 are engaged with the carriage datums CZ1, CZ2, and the print cartridge datum PY3 is engaged with the carriage datum CY3.

As depicted in FIG. 16, the clamp blade 179 pivots as the latch arm 151 continues to be rotated toward the latched position, and the ramp surface 179*b* of the clamp blade 179 eventually contacts the front lateral edge 50*b* of the latch feature and lifts the clamp blade off the top wall 31 of the print cartridge.

Figure 17:
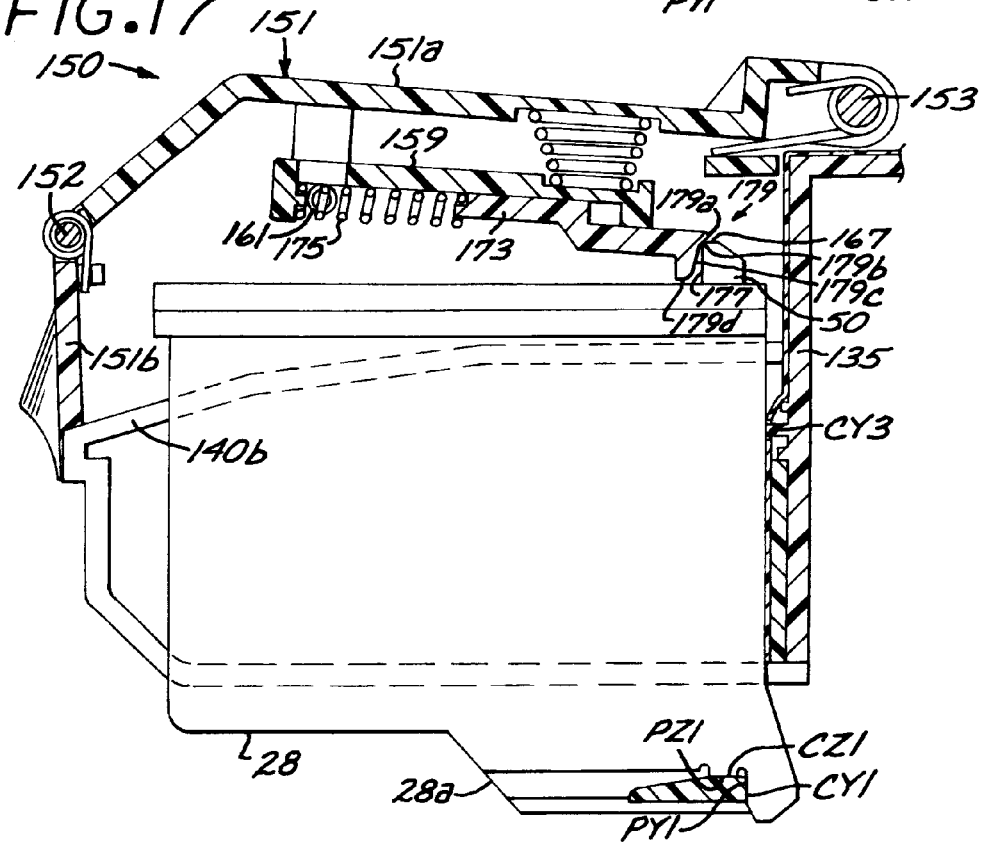

As depicted in FIG. 17, the ramp surface 179*b* slides across the front lateral edge 50*b* of the latch feature and eventually the clamp blade lower surface 179*c* contacts the front surface 50*a* of the latch feature so that the top of the front lateral edge 50*b* and the front surface 50*a* of the latch feature are engaged by the ramp surface 179*b* and the lower surface 179*c* of the clamp blade, as depicted in FIG. 10. For example, the top of the front lateral edge 50*b* is engaged by a portion of the ramp surface 179 that is near the vertex of the angle A. The clamp blade is clear of the top surface of the print cartridge when the top front surfaces of the latch feature are engaged by the clamp blade ramp and lower surfaces.

The latch arm 151 is further displaced to engage the latch hooks 155 with the latch tabs 157, which allows the clamp blade 179 to continually push on the top of the latch feature 50 generally along the Z-axis and on the front of the latch feature generally along the Y-axis, so that the print cartridge datums PY1, PY2, PY3, PZ1, PZ2 are continually engaged with the corresponding carriage datums CY1, CY2, CY3, CZ1, CZ2. This is the result the resilient deflection of the clamp blade as it was pushed against the top surface of the print cartridge and the latch feature.

Generally, the clamp blade 179 at first pushes down on the print cartridge generally along the Z-axis to engage the print cartridge Z-axis datums PZ1, PZ2 with the carriage Z-axis datums CZ1, CZ2, and then pushes on the latch feature 50 to engage the print cartridge Y-axis datums PY1, PY2, PY3 with the carriage Y-axis datums CY1, CY2, CY3. The clamp then engages the latch feature 50 of the print cartridge 11 to continually bias the print cartridge Z-axis and Y-axis datums against the corresponding carriage Z-axis and Y-axis datums.

In addition to the Z and Y seating achieved by the clamp, the wire spring 146 pushes the cartridge generally along the X axis so that the print cartridge datum PX1 is snugly engaged with the carriage datum CX1. In this manner, the print cartridge datums are snugly seated against corresponding carriage datums, which fixes the position of the print cartridge in the chute 131.

Although the foregoing has been a description and illustration of specific embodiments, various modifications and changes thereto can be made by persons skilled in the art without departing from the scope of the invention as defined by the following claims.

What is claimed is:

1. Apparatus for supporting a print cartridge, comprising:

a chute for receiving the print cartridge;

a latch arm hingeably attached to said chute for rotation about a latch arm rotation axis; and a clamp structure supported by said latch arm and supporting a clamp blade to be deflected about a clamp rotation axis and deflected along a clamp translation axis when the clamp blade is pushed against the print cartridge.

2. The apparatus of claim 1 wherein said clamp structure comprises:

a clamp base hingeably attached to said latch arm for rotation about said clamp rotation axis;

a sliding clamp including said clamp blade slidably supported by said clamp base for translation along said clamp translation axis;

a first resilient structure that resiliently resists rotation of said clamp base about said clamp rotation axis toward said latch arm; and a second resilient structure that resiliently resists displacement of said sliding clamp along said clamp translation axis toward said clamp rotation axis.

3. The apparatus of claim 1 wherein said clamp blade includes an upper clamp blade surface and a lower clamp blade surface that subtend an obtuse angle.

4. The apparatus of claim 1 wherein said clamp blade includes an upper clamp blade surface and a lower clamp blade surface that subtend an angle of about 135 degrees.

5. The apparatus of claim 1 wherein said latch arm rotation axis and clamp rotation axis are generally parallel to a carriage scan axis.

6. The apparatus of claim 1 wherein said clamp translation axis is generally orthogonal to a carriage scan axis.

7. The apparatus of claim 1 wherein said clamp blade generally resembles a bulldozer blade.

8. A printer that includes the apparatus of claim 1.

9. Apparatus for supporting a print cartridge having a latch feature on a top surface thereof, comprising:

a chute for receiving the print cartridge;

a latch arm hingeably attached to said chute for rotation about a latch arm rotation axis;

a clamp structure supported by said latch arm and supporting a clamp blade to be resiliently deflected about a clamp rotation axis and resiliently deflected along a clamp translation axis when the clamp blade is pushed against the print cartridge by rotation of the latch arm to a latched position;

wherein said clamp blade slides along the top surface of the print cartridge toward the latch feature and eventually contacts and engages the latch feature as said latch arm is rotated to said latched position; and wherein said clamp blade pushes on the top surface generally along a Z-axis as it slides toward the latch feature, said clamp blade pushes on the latch feature generally along a Y-axis that is orthogonal to the Z-axis when it contacts the latch feature, and said clamp blade pushes on the latch feature generally along Y-axis and the Z-axis when it is engaged with the latch feature.

10. The apparatus of claim 9 wherein said clamp structure comprises:

a clamp base hingeably attached to said latch arm for rotation about said clamp hinge axis;

a sliding clamp including said clamp blade slidably supported by said clamp base for translation along said clamp translation axis;

a first resilient structure that resiliently resists rotation of said clamp base about said clamp rotation axis toward said latch arm; and a second resilient structure that resiliently resists translation of said sliding clamp along said translation axis toward said clamp rotation axis.

11. The apparatus of claim 10 wherein said clamp blade includes an upper clamp blade surface and a lower clamp blade surface that subtend an obtuse angle.

12. The apparatus of claim 10 wherein said clamp blade includes an upper clamp blade surface and a lower clamp blade surface that subtend an angle of about 135 degrees.

13. The apparatus of claim 11 wherein said clamp blade includes a lower edge that pushes on the top surface of the print cartridge generally along the Z-axis as the clamp blade slides along the top surface.

14. The apparatus of claim 11 wherein said upper clamp blade surface comprises a ramp that slides over an edge of the latch feature.

15. The apparatus of claim 11 wherein said lower clamp blade surface pushes on the latch feature generally along the Y-axis after the clamp blade has engaged the latch feature of the print cartridge.

16. The apparatus of claim 11 wherein said upper clamp blade surface pushes on the latch feature generally along the Z-axis after the clamp blade has engaged the latch feature of the print cartridge.

17. The apparatus of claim 9 wherein said latch hinge axis and clamp hinge axis are generally parallel to a carriage scan axis.

18. The apparatus of claim 9 wherein said clamp slide axis is generally orthogonal to a carriage scan axis.

19. The apparatus of claim 9 wherein said clamp blade generally resembles a bulldozer blade.

20. The apparatus of claim 9 wherein said clamp blade is lifted off the top surface of the print cartridge when said clamp blade is engaged with the latch feature.

21. The apparatus of claim 9 wherein:

said chute includes a resilient structure for applying a force on the print cartridge along an X-axis that is orthogonal to said Y-axis and said Z-axis; and said clamp blade has a width configured to compensate for a rotation inducing moment caused by the force applied by the resilient structure.

22. A printer that includes the apparatus of claim 9.

23. Apparatus for supporting a print cartridge, comprising:

a chute for receiving the print cartridge and having carriage Y-axis datums and Z-axis datums;

a resilient pad disposed at a rear portion of said chute and engageable by a rear portion of the print cartridge;

a latch arm hingeably attached to said chute for rotation about a latch arm rotation axis;

a pivoting clamp base supported by said latch arm for rotation about a clamp rotation axis;

a sliding clamp arm supported by said pivoting clamp base and slidable relative thereto;

a clamp blade supported by said sliding clamp arm; and wherein said clamp blade pivotingly pushes the print cartridge generally along a Z-axis, as said latch arm is rotated toward a latched position, so that the print cartridge contacts said Z-axis datums, and further pushes the print cartridge against said resilient pad and generally along a Y-axis that is orthogonal to the Z-axis, as said latch arm is further rotated toward the latched position, so that the print cartridge rotates about an X-axis that is orthogonal to said Z-axis and said Y-axis, and contacts said Y-axis datums.

24. The apparatus of claim 23 wherein said clamp blade includes an upper clamp blade surface and a lower clamp blade surface that subtend an obtuse angle.

25. The apparatus of claim 23 wherein clamp blade includes an upper clamp blade surface and a lower clamp blade surface that subtend an angle of about 135 degrees.

26. The apparatus of claim 23 wherein said latch arm rotation axis and clamp rotation axis are generally parallel to a carriage scan axis.

27. The apparatus of claim 23 wherein said sliding clamp slides along a clamp translation axis is generally orthogonal to said clamp rotation axis.

28. The apparatus of claim 23 wherein said clamp blade generally resembles a bulldozer blade.

29. A printer that includes the apparatus of claim 23.

30. Apparatus for supporting a print cartridge having a latch feature on a top surface thereof, comprising:

a chute for receiving the print cartridge and having carriage Y-axis datums and Z-axis datums;

a latch arm hingeably attached to said chute for rotation about a latch arm axis;

a clamp base supported by said latch arm to pivot about a clamp rotation axis that is generally parallel to said latch arm axis;

a clamp arm slidably supported by said clamp base for displacement along a clamp translation axis;

a clamp blade disposed at a distal end of said clamp arm;

wherein an acute angle is formed by an imaginary line segment that extends from the clamp rotation axis to the latch arm rotation axis and said clamp translation axis;

a first resilient structure for resiliently resisting rotation of said clamp base toward said clamp arm;

a second resilient structure for resiliently resisting translation of said clamp arm toward said clamp rotation axis; and wherein said clamp blade is moved into engagement with the latch feature by rotation of the latch arm to a latched position.

31. A printer that includes the apparatus of claim 30.

32. Apparatus for supporting a print cartridge having a latch feature on a top surface thereof, comprising:

a chute for receiving the print cartridge;

a latch arm hingeably attached to said chute for rotation about a latch arm rotation axis; and clamping means supported by said latch arm for initially pushing down on the print cartridge generally along a Z-axis as the latch arm is rotated toward a latched position, and subsequently pushing on the latch feature along a Y-axis that is orthogonal to the Z-axis; and said clamping means further for engaging the latch feature to continually bias the print cartridge along the Z-axis and the Y-axis.

33. A printer that includes the apparatus of claim 32.

34. A method of latching a print cartridge having a latching feature in a printing apparatus, comprising:

sliding a clamp blade across a top surface of the print cartridge toward the latching feature;

while sliding the clamp blade, pushing the clamp blade against the top surface of the print carriage to apply a first clamping force to a top surface of the print cartridge along a first direction;

contacting the latch feature with the clamp blade;

applying a second clamping force to a front surface of the latching feature along a second direction that is generally orthogonal to the first direction; and applying the first clamping force to a top of the latching feature.

35. The method of claim 34 wherein pushing the clamp blade against the top surface of the print cartridge comprises pushing on a resilient structure that in turn pushes on a clamp structure that supports the clamp blade.

36. The method of claim 34 wherein contacting the latch feature comprises pushing the clamp blade against the front surface of the latching feature.

37. The method of claim 34 wherein contacting the latch feature comprises pushing a ramp surface of the clamp blade against an edge of the latch feature that is adjacent the top surface of the latch feature.

38. The method of claim 34 wherein applying the second clamping the front surface of the latch feature comprises pushing a lower surface of the clamp blade against the front surface of the latch feature.

* * * * *